United States Patent [19]

Newman et al.

[11] Patent Number: 4,932,907

[45] Date of Patent: Jun. 12, 1990

[54] CHAIN DRIVEN MARINE PROPULSION SYSTEM WITH STEERABLE GEARCASE AND DUAL COUNTERROTATING PROPELLERS

[75] Inventors: Neil A. Newman, Omro; Herbert A. Bankstahl; Wayne T. Beck, both of Fond du Lac, all of Wis.

[73] Assignee: Brunswick Corporation, Skokie, Ill.

[21] Appl. No.: 253,047

[22] Filed: Oct. 4, 1988

[51] Int. Cl.[5] ..... B63H 25/42

[52] U.S. Cl. ..... 440/57; 440/58; 440/75; 440/80

[58] Field of Search ..... 440/53, 57, 58, 54, 440/75, 80, 81, 83, 86; 416/128, 129 R, 129 A

[56] References Cited

U.S. PATENT DOCUMENTS

| | | | |
|---|---|---|---|
| 2,064,195 | 12/1936 | De Michelis | 440/81 |
| 2,196,706 | 4/1940 | Naginskas | 440/81 |
| 2,372,247 | 3/1945 | Billing | 440/81 |
| 3,795,219 | 3/1974 | Peterson | 440/75 |
| 3,951,096 | 4/1976 | Dunlap | 440/75 |

FOREIGN PATENT DOCUMENTS

| | | | |
|---|---|---|---|
| 1310472 | 3/1973 | United Kingdom | 416/129 A |

*Primary Examiner*—Sherman D. Basinger
*Assistant Examiner*—Stephen P. Avila
*Attorney, Agent, or Firm*—Andrus, Sceales, Starke & Sawall

[57] ABSTRACT

A marine propulsion system includes a steerable lower gearcase portion and a drive mechanism including a chain drive for driving dual counterrotating propellers. The dual propellers are rotatably mounted to the lower steerable gearcase portion by means of inner and outer coaxially extending propeller shafts. A sprocket is mounted to each propeller shaft, and first and second chain portions extend between the propeller shaft sprockets and a pair of upper drive sprockets, preferably disposed above the water line during boat operation. Coaxially extending inner and outer drive shafts are interconnected with the engine output shaft, and are adapted for counterrotation in response to rotation thereof. The coaxial drive shafts are interconnected with the upper drive sprockets for driving such sprockets in opposite rotational directions, thereby resulting in movement of the first and second chain portions in opposite directions. The longitudinal axis of the inner and outer drive shafts defines the steering axis about which the lower steerable gearcase portion is pivotable.

14 Claims, 2 Drawing Sheets

FIG. 1
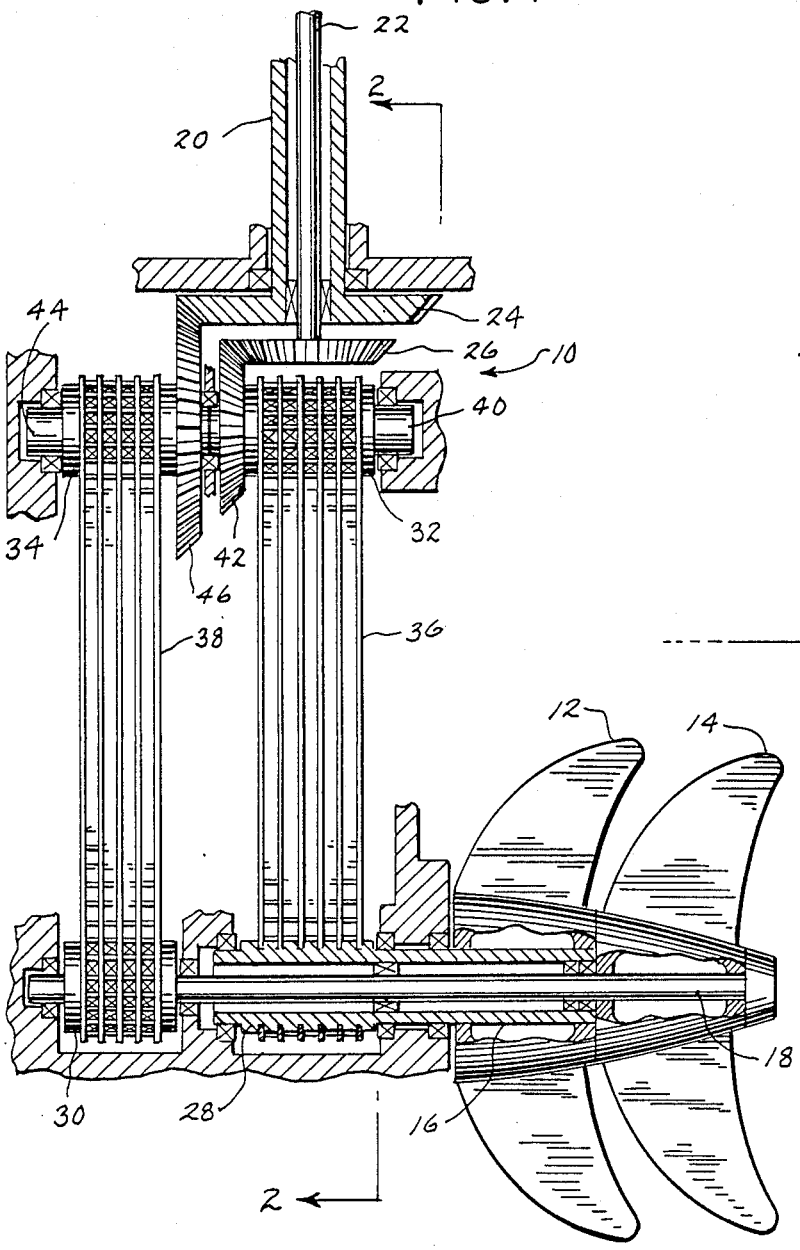
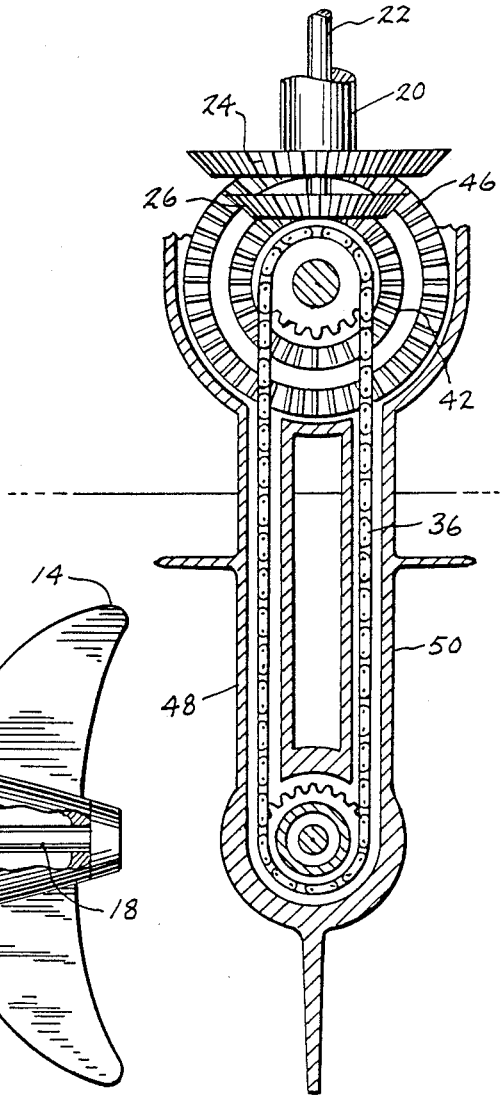
FIG. 2

CHAIN DRIVEN MARINE PROPULSION SYSTEM WITH STEERABLE GEARCASE AND DUAL COUNTERROTATING PROPELLERS

BACKGROUND OF THE INVENTION

This invention relates to a marine propulsion system, and more particularly to such a system incorporating dual counterrotating propellers.

It is known to provide dual counterrotating propellers in a marine propulsion system in order to reduce or eliminate hydrodynamics inefficiencies present in a single propeller system. For example, it is known that, in a single propeller system, torque loads imposed by the rotating single propeller must be overcome in order to effect steering of the system. Utilization of dual counterrotating propellers substantially reduces or eliminates such torque loads.

It has been found that employing a chain drive mechanism for driving the propeller in a marine propulsion system results in improved operation of the system. One such system is disclosed in copending application Ser. No. 07/224,994 filed Sept. 15, 1988, and entitled "Stern Drive Marine Propulsion System Including A Chain Drive Mechanism". Further, it has been found that a chain drive mechanism can advantageously be employed in a dual counterrotating propeller system. One such system is disclosed in copending application Ser. No. 07/224,994 filed Sept. 9, 1988, and entitled "Chain Drive Marine Propulsion System With Dual Counterrotating Propellers".

A gearcase including a steerable lower portion has proven effective in certain applications. One such steerable gearcase structure is disclosed in copending application Ser. No. 07/253,046 filed Oct. 4, 1988, and entitled "Gear Driven Marine Propulsion Systems With Steerable Gearcase And Dual Counterrotating Propellers".

The present invention is intended to achieve the benefits of a chain drive Counterrotating propeller system, in combination with advantages offered by a steerable gearcase structure. In accordance with the invention, a marine drive including an engine having a rotatable output shaft is provided with a depending gearcase having an upper portion and a lower steerable portion. The lower steerable portion is mounted to the upper gearcase portion so as to be pivotable about a steering axis. First and second propeller shafts are rotatably mounted to the lower steerable portion of the gearcase, and first and second propellers are mounted to the first and second propeller shafts, respectively. Chain means is drivingly interconnected between the engine output shaft and the first and second propeller shafts. The chain means includes a first portion for driving the first propeller shaft and a second portion for driving the second propeller shaft. Counterrotation drive means is provided for driving the first and second portions of the chain means in opposite directions in response to rotation of the engine output shaft. Accordingly, counterrotation of the first and second propeller shafts and the first and second propellers is thereby provided. The counterrotation drive means accommodates pivoting movement of the lower steerable gearcase portion about the steering axis. In one embodiment, the first and second propeller shafts are disposed one within the other, and are substantially coaxial. The first and second portions of the chain means extend between the first and second propeller shafts and a pair of rotatable intermediate drive members, with the counterrotation drive means providing rotation of the intermediate drive members in opposite rotatational directions. The intermediate drive members are preferably disposed above the water line during boat operation, thereby reducing the frontal area of the submerged portion of the steerable gearcase. The counterrotation drive means preferably comprises a pair of coaxially extending shafts interconnected with the engine output shaft so as to rotate in opposite directions in response to rotation of the engine output shaft. The longitudinal axis of the coaxial shafts preferably defines the steering axis about which the lower steerable gearcase portion is pivotable. In the disclosed embodiment, gear means is provided between the engine output shaft and the coaxial shafts for providing counterrotation thereof. The coaxial shafts are preferably interconnected with the intermediate driving members through appropriate gearing so as to provide counterrotation thereof.

While the invention is applicable to either an outboard or inboard/outboard stern drive system, a stern drive embodiment of the invention is disclosed. The steerable gearcase portion is provided with an upwardly extending projection which is rotatably mounted to the upper gearcase portion by means of bearings or the like. In this manner, the lower gearcase portion is suspended from the upper gearcase portion. A rack and pinion mechanism is provided in the upper gearcase portion for effecting pivoting movement of the upwardly extending projection of the lower gearcase portion about the steering axis.

BRIEF DESCRIPTION OF THE DRAWINGS

The drawings illustrate the best mode presently contemplated of carrying out the invention.

In the drawings:

FIG. 1 is a partial elevation view, with portions broken away, showing the various components of the drive system of the invention which can advantageously be employed in either an outboard or a stern drive system;

FIG. 2 is a sectional view taken generally along line 2—2 of FIG. 1;

DETAILED DESCRIPTION OF THE PREFERRED EMBODIMENT

Figure 3:
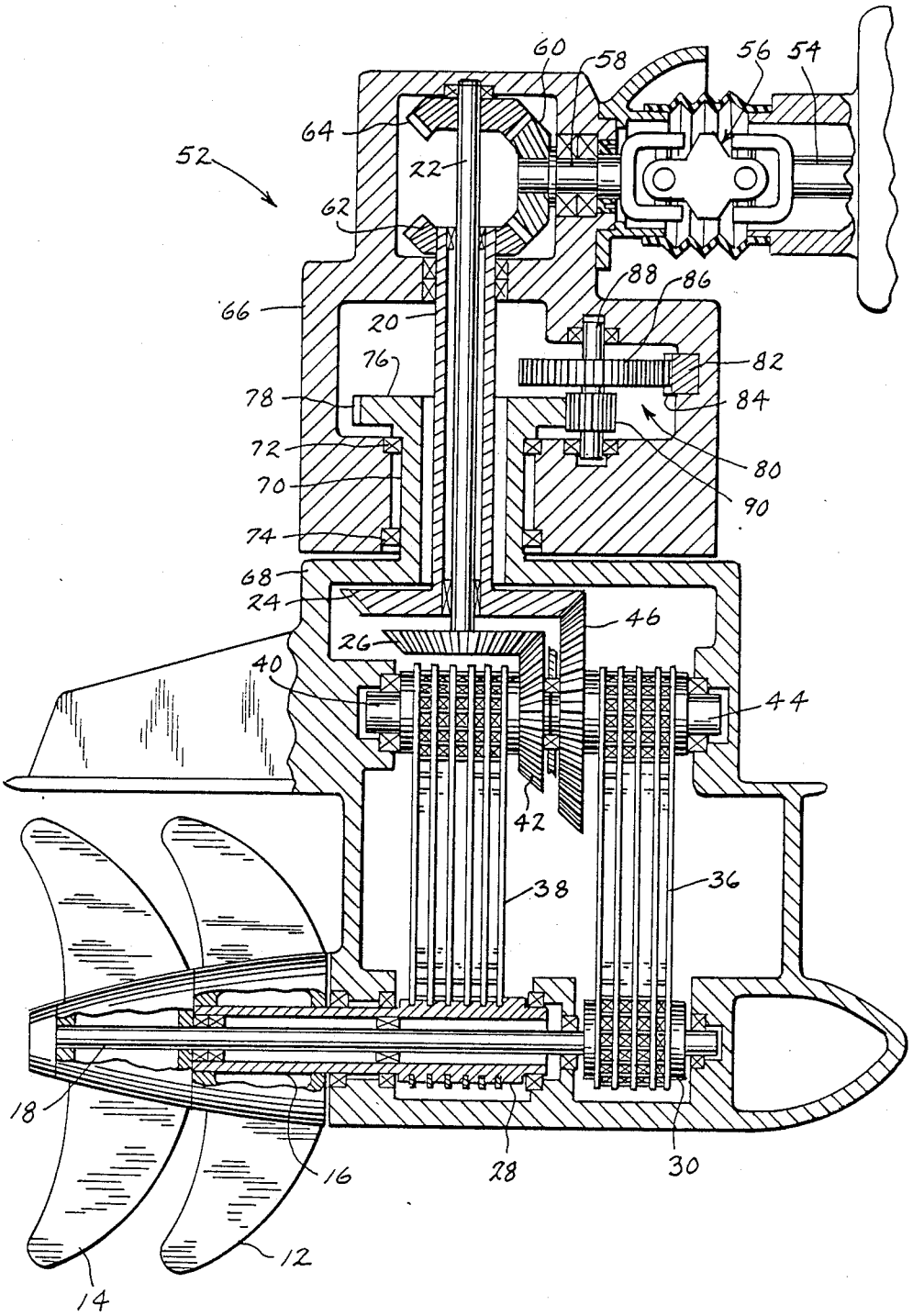
FIG. 3 is a view similar to FIG. 1, showing the invention as employed in a stern drive system.

With reference to FIG. 1, a generic embodiment of the invention is illustrated. The illustrated components of the invention can be utilized in either an outboard system or an inboard/outboard stern drive system. As shown, a drive mechanism 10 includes a front propeller 12 and a rear propeller 14. Front propeller 12 is mounted to a rotatable outer propeller shaft 16, while rear propeller 14 is mounted to a rotatable inner propeller shaft 18. As will be explained, outer and inner propeller shafts 16, 18 are adapted to be rotatably mounted to a depending lower portion of a marine drive gearcase. As shown, inner propeller shaft 18 is disposed within the interior of outer propeller shaft 16, which is hollow in cross section. Propeller shafts 16, 18 are substantially coaxial.

Drive mechanism 10 is provided at its upper portion with a depending outer drive shaft 20 and a depending inner drive shaft 22. Outer and inner drive shafts 20, 22 are interconnected through a counterrotation drive mechanism with an engine output shaft (not shown), so that outer and inner drive shafts 20, 22 counterrotate in response to rotation of the engine output shaft. Outer drive shaft 20 has a counterrotation drive gear 24 fixed to its lower end, while inner drive shaft 22 has a counterrotation drive gear 26 fixed to its lower end.

Outer propeller shaft 16 has a sprocket 28 fixed to its inner end, and inner drive shaft 18 likewise has a sprocket 30 fixed to its inner end. A drive sprocket 32 is disposed above outer propeller shaft drive sprocket 28 and is aligned therewith. Likewise, a drive sprocket 34 is disposed above and aligned with inner propeller shaft sprocket 30. A pair of drive chains 36, 38 are provided about sprockets 28, 32 and 30, 34, respectively.

Upper drive sprocket 32 is mounted to a rotatable upper jack shaft 40, and a counterrotation driven gear 42 is fixed to drive sprocket 32 and jack shaft 40. As shown, counterrotation driven gear 42 is engageable with counterrotation drive gear 26 fixed to inner drive shaft 22. In a like manner, upper drive sprocket 34 is mounted to a rotatable jack shaft 44, as is a counterrotation driven gear 46. Counterrotation driven gear 46 is engageable with counterrotation drive gear 24 provided at the lower end of outer drive shaft 20.

With the described construction, counterrotation of outer and inner drive shafts 20, 22 is transferred through counterrotation drive gears 24, 26 and counterrotation driven gear 42, 46 to upper drive sprockets 32, 34. Such counterrotation of drive sprockets 32, 34 results in movement of drive chains 36, 38 in opposite directions. Counterrotation of lower sprockets 28, 30, and thereby propeller shafts 16, 18 and propellers 12, 14, is thus provided.

While FIG. 1 illustrates the invention as employing a chain drive mechanism, it is to be understood that a suitable notched belt could be employed for transferring rotation of drive sprockets 32, 34 to lower sprockets 28, 30.

With reference to FIG. 2, it is seen that the upper components of the counterrotation chain drive mechanism of the invention are disposed above the water line during boat operation. With this construction, the vertically extending runs of chains 36, 38 are housed within a pair of spaced depending struts 48, 50, so that a gap is formed therebetween. This structure minimizes the frontal area of the submerged components of the lower gearcase portion, thereby resulting in reduced drag during boat operation. Additionally, the chain drive structure of the invention allows employment of high reduction ratios, if necessary, between gears 24, 46 and gears 26, 42; resulting in efficient operation.

FIG. 3 illustrates the invention as employed in an inboard/outboard stern drive system. In this system, an inboard mounted engine is drivingly connected to a stern drive unit 52 adapted for mounting to the transom of a boat. The inboard mounted engine includes a rotatable output shaft 54 interconnected at its leftward end with a universal joint, shown generally at 56. An upper horizontal power shaft 58 is connected at its rightward end to universal joint 56, and an input bevel gear 60 is mounted to the leftward end of power shaft 58.

Input bevel gear 60 is drivingly engaged with a bevel gear 62 fixed to the upper end of outer drive shaft 20, and with a bevel gear 64 fixed to the upper end of inner drive shaft 22. With this construction, counterrotation of bevel gears 62, 64 is provided in response to rotation of engine output shaft 54, thereby causing counterrotation of outer and inner drive shafts 20, 22 respectively.

Although not shown in FIG. 3, a satisfactory reversing transmission is preferably disposed between engine output shaft 54 and input bevel gear 60 for controlling the direction of rotation of input bevel gear 60, and thereby the direction of boat operation.

As shown, outer and inner drive shafts 20, 22 are rotatably mounted within an upper gearcase portion 66. A pivotably mounted steerable lower gearcase portion 68 is mounted to upper gearcase portion 66 for pivoting movement relative thereto about a steering axis defined by the longitudinal axis of outer and inner drive shafts 20, 22. The remaining components of drive mechanism 10 are housed within lower steerable gearcase portion 68, and propellers 12, 14 are mounted exteriorly thereof.

Lower steerable gearcase portion 68 has an upstanding projecting portion 70 connected thereto and rotatably mounted to upper gearcase portion 66. Upstanding projecting portion 70 is substantially circular in plan and extends coaxially relative to outer and inner drive shafts 20, 22. Upstanding projecting portion 70 is suspended from upper gearcase portion 66 by means of a pair of bearings 72, 74, which accommodate movement of lower gearcase portion 68 relative to upper gearcase portion 66.

A lip 76 is provided at the upper end of upstanding projecting portion 70, and a series of outwardly extending teeth 78 are formed thereon. As a means for effecting pivoting movement of upstanding portion 70 of lower gearcase portion 68 relative to upper gearcase portion 66, a rack and pinion mechanism 80 is mounted within the interior of upper gearcase portion 66. Rack and pinion mechanism 80 includes a longitudinally moveable rack 82 moveable in response to operator command and having a series of teeth 84 formed thereon. A gear 86 is engageable with teeth 84 of rack 82, and is mounted to a pin 88 rotatably supported within upper gearcase portion 66. A pinion 90 is also fixed to pin 88, and has a series of teeth engageable with outwardly extending teeth 78 formed on upper lip 76 provided on upstanding projecting portion 70. With this construction, longitudinal back and forth movement of rack 82 in response to operator command results in rotation of gear 86, which is transferred through pin 88 to pinion 90 and to upstanding projecting portion 70 through teeth 78 and lip 76. Pivoting movement of lower steerable gearcase portion 68 relative to upper gearcase portion 66 is thus provided.

With the described construction, counterrotation drive gears 24, 26 provide cancelling gear torque loads during steering of lower steerable gearcase portion about its steering axis as defined by drive shafts 20, 22. Likewise, counterrotation of propellers 12, 14 provide cancelling propeller torque loads about the steering axis. Steering of lower steerable gearcase portion 68 is thus more easily effected.

Various alternatives and modifications are contemplated as being within the scope of the following claims particularly pointing out and distinctly claiming the subject matter regarded as the invention.

We claim:

1. In a marine drive for a boat, said marine drive including an engine having a rotatable output shaft, the improvement comprising:

a depending gearcase having an upper portion and a lower steerable portion pivotably mounted to said upper portion so as to ba pivotable about a steering axis;

a first propeller shaft rotatably mounted to said lower steerable portion of said gearcase;

a second propeller shaft rotatably mounted to said lower steerable portion of said gearcase;

a first propeller mounted to said first propeller shaft;

a second propeller mounted to said second propeller shaft;

flexible drive means drivingly interconnected between said engine output shaft and said first and second propeller shafts, said flexible drive means including a first portion for driving said first propeller shaft and a second portion for driving said second propeller shaft; and counterrotation drive means for driving said first and second portions of said flexible drive means in opposite directions in response to rotation of said engine output shaft, and thereby providing rotation of said first and second propeller shafts in opposite rotational directions, said counterrotation drive means accommodating pivoting movement of said lower steerable portion of said gearcase about said steering axis.

2. The improvement according to claim 1, wherein said flexible drive means comprises chain means drivingly interconnected between said engine output shaft and said first and second propeller shafts, and comprising a first chain portion and a second chain portion.

3. The improvement according to claim 2, wherein said first and second propeller shafts are disposed one within the other, and are substantially coaxial.

4. In a marine drive for a boat, said marine drive including an engine having a rotatable output shaft, the improvement comprising:

a depending gearcase having an upper portion and a lower steerable portion mounted to said upper portion so as to be pivotable about a steering axis;

a first propeller shaft rotatably mounted to said lower steerable portion of said gearcase;

a second propeller shaft rotatably mounted to said lower steerable portion of said gearcase;

wherein said first and second propeller shafts are disposed one within the other, and are substantially coaxial;

a first propeller mounted to said first propeller shaft;

a second propeller mounted to said second propeller shaft;

flexible drive means comprising chain means drivingly interconnected between said engine output shaft and said first and second propeller shafts, said chain means including a first portion for driving said first propeller shaft and a second portion for driving said second propeller shaft; and counterrotation drive means for driving said first and second portions of said flexible drive means in opposite directions in response to rotation of said engine output shaft, and thereby providing rotation of said first and second propeller shafts in opposite rotational directions, said counterrotation drive means accommodating pivoting movement of said lower steerable portion of said gearcase about said steering axis;

wherein said first and second portions of said chain means extend between said respective first and second propeller shafts and a pair of rotatable intermediate drive members, and wherein said counterrotation drive means provides rotation of said intermediate drive members in opposite rotational directions for providing movement of said first and second chain portions in opposite directions.

5. The improvement according to claim 4, wherein said pair of intermediate drive members are disposed above the water line during boat operation.

6. The improvement according to claim 4, wherein said counterrotation drive means comprises axially extending shaft means drivingly interconnected with said engine output shaft so as to be rotatable in response to rotation thereof, and wherein the longitudinal axis of said shaft means defines said steering axis so as to accommodate pivoting movement of said steerable gearcase portion thereabout.

7. The improvement according to claim 6, wherein said shaft means comprises inner and outer axially extending coaxial drive shafts, and wherein said counterrotation drive means comprises gear means interposed between said engine output shaft and said inner and outer drive shafts for providing counterrotation of said inner and outer drive shafts, and further comprising drive means interposed between said inner and outer shafts and said pair of intermediate drive members for providing counterrotation thereof in response to the counterrotation of said intermediate drive members.

8. The improvement according to claim 7, wherein said gear means interposed between said engine output shaft and said inner and outer drive shafts comprises a counterrotation drive bevel gear interconnected with said engine output shaft so as to be rotatable in response to rotation thereof, and counterrotation driven bevel gears fixed to each of said inner and outer drive shafts and engageable with said counterrotation drive bevel gear so as to counterrotate in response to rotation thereof for providing counterrotation of said inner and outer drive shafts.

9. The improvement according to claim 7, wherein said drive means interposed between said inner and outer shafts and said pair of intermediate drive members comprises a drive gear fixed to each of said inner and outer drive shafts, and a driven gear fixed to each of said intermediate drive members, said drive gears and said driven gears being engageable with each other so as to provide counterrotation of said intermediate drive members in response to the counterrotation of said inner and outer drive shafts.

10. The improvement according to claim 9, wherein said pair of intermediate drive members comprises first and second rotatably mounted sprockets engageable with said first and second chain portions, each said sprocket being innerconnected with one of said driven gears for providing counterrotation of said sprockets, and thereby movement of said first and second chain portions in opposite directions.

11. The improvement according to claim 4, further comprising steering means for providing pivoting movement of said lower steerable gearcase portion about said steering axis.

12. The improvement according to claim 11, wherein said steering means comprises an upstanding projecting portion connected to said lower steerable gearcase portion and rotatably mounted to said upper gearcase portion, said steering means acting on said upstanding projecting portion for providing pivoting movement of said lower steerable gearcase portion about said steering axis.

13. The improvement according to claim 12, wherein said steering means comprises moveable rack and pinion means acting on said upstanding projecting portion of said lower steerable gearcase portion for providing pivoting movement thereof about said steering axis.

14. The improvement according to claim 4, wherein said lower steerable gearcase portion includes a pair of spaced struts for housing the vertical runs of said first and second chain portions, with the space between said struts reducing the frontal area of said lower steerable gearcase portion and thereby the hydrodynamic drag caused by the lower steerable gearcase portion during boat operation.

* * * * *

UNITED STATES PATENT AND TRADEMARK OFFICE

CERTIFICATE OF CORRECTION

PATENT NO. : 4,932,907

DATED : June 12, 1990

INVENTOR(S) : Neil A. Newman et al

It is certified that error appears in the above-identified patent and that said Letters Patent is hereby corrected as shown below:

Col. 4, line 67

Delete "ba" and substitute therefor -- be --

Signed and Sealed this

Sixteenth Day of July, 1991

*Attest:*

HARRY F. MANBECK, JR.

*Attesting Officer*

*Commissioner of Patents and Trademarks*